US005613176A

United States Patent [19]

Grace

[11] Patent Number: 5,613,176

[45] Date of Patent: Mar. 18, 1997

[54] IMAGE ON IMAGE PROCESS COLOR WITH TWO BLACK DEVELOPMENT STEPS

[75] Inventor: Robert E. Grace, Fairport, N.Y.

[73] Assignee: Xerox Corporation, Stamford, Conn.

[21] Appl. No.: 618,054

[22] Filed: Mar. 25, 1996

[51] Int. Cl.[6] ..... G03G 15/01

[52] U.S. Cl. ..... 399/223

[58] Field of Search ..... 355/326 R, 327, 355/328; 118/645

[56] References Cited

U.S. PATENT DOCUMENTS

| | | | |
|---|---|---|---|
| 5,160,969 | 11/1992 | Mizuma et al. | 355/326 R |
| 5,208,636 | 5/1993 | Rees et al. | 355/219 |
| 5,258,820 | 11/1993 | Tabb | 355/328 |
| 5,260,753 | 11/1993 | Haneda et al. | 355/326 R X |
| 5,281,999 | 1/1994 | Edmunds | 355/202 |
| 5,305,070 | 4/1994 | Snelling | 355/326 R |
| 5,357,318 | 10/1994 | Haneda et al. | 355/210 |
| 5,429,898 | 7/1995 | Sugizaki et al. | 430/45 |
| 5,436,711 | 7/1995 | Hauser | 355/290 |
| 5,452,074 | 9/1995 | VonHoene et al. | 355/326 R |

*Primary Examiner*—Arthur T. Grimley
*Assistant Examiner*—Sophia S. Chen

[57] ABSTRACT

A printing system using a recharge, expose and development image on image process color system is disclosed in which there is an optional extra black development step. The printing system may be a single pass system where all of the colors are developed in a single pass or a multi-pass system where each color is developed in a separate pass. The additional black development step results in optimal color quality with black toner being developed in a first and/or last sequence. Having more than one black development station allows low gloss and high gloss black toner to be applied to the same image, enabling the very desirable combination of low gloss text and high gloss pictorials on the same page.

20 Claims, 4 Drawing Sheets

IMAGE ON IMAGE PROCESS COLOR WITH TWO BLACK DEVELOPMENT STEPS

BACKGROUND OF THE INVENTION

This invention relates generally to color imaging and the use of plural exposure and development steps for such purposes and more particularly to the optimum use of black development steps.

One method of printing in different colors is to uniformly charge a charge retentive surface and then expose the surface to information to be reproduced in one color. This information is rendered visible using marking particles followed by the recharging of the charge retentive surface prior to a second exposure and development. This recharge/expose/and develop (REaD) process may be repeated to subsequently develop images of different colors in superimposed registration on the surface before the full color image is subsequently transferred to a support substrate. The different colors may be developed on the photoreceptor in an image on image development process, or a highlight color image development process (image next-to image). Each different image may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

In the creation of a "REaD" image on image (IOI) process color image the placement of the black toner development step in the process sequence creates some difficulty. Once black toner has been deposited, no further colors can be placed at that point in the image because the black toner absorbs subsequent exposure illumination. This can be an advantage when trying to mask registration errors in which case black first is desired, but it also limits the use of black for undercolor removal and for extending the gamut of dark yellow, magenta and red hues, which are advantages of developing black last. Black first, depositing black toner first in the imaging process, and black last, depositing black toner last in the imaging process, both have advantages in different portions of the color image. A solution is to employ black development twice during the creation of a color image; black first to provide masking in some portions of the image, then the primary colors, then black last in those portions of the image where black-on-color gives a color gamut superior to that of black next-to color.

An extension of having black developed twice in the image creation process is to have two black developing steps that take place at two different developing stations; one black developing station having a relatively high gloss toner and the other black developing station having a relatively low gloss toner. This would enable the desirable combination of low gloss text and high gloss pictorials on the same page which is a very desirable result.

Various types of printing machines have hereinbefore been used as illustrated by the following disclosures, which may be relevant to certain aspects of the present invention.

U.S. Pat. No. 5,208,636

Inventor: Rees et al.

Issued: May 4, 1993

U.S. Pat. No. 5,258,820

Inventor: Tabb

Issued: Nov. 2, 1993

U.S. Pat. No. 5,281,999

Inventor: Edmunds

Issued: Jan. 25, 1994

U.S. Pat. No. 5,305,070

Inventor: Snelling

Issued: Apr. 19, 1994

U.S. Pat. No. 5,452,074

Inventor: VonHoene et al.

Issued: Sep. 19, 1995

U.S. Pat. No. 5,429,898

Inventor: Sugizaki et al.

Issued: Jul. 4, 1995

U.S. Pat. No. 5,436,711

Inventor: Hauser

Issued: Jul. 25, 1995

U.S. Pat. No. 5,357,318

Inventor: Haneda et al.

Issued: Oct. 18, 1994

Rees et al. teaches a printing machine in which two electrostatic latent images are recorded on a photoconductive member. One of the latent images is a CAD image with the other image being a DAD image. A magnetic developer unit develops the charged area latent image with black toner particles. A non-magnetic developer unit develops the DAD image with toner particles, which may be a black or non-black color.

Tabb discloses a multi-color imaging apparatus using a recharge step between two image creation steps for conditioning a charge retentive surface pursuant to forming the second of the two images, the voltage differential between developed and undeveloped areas of a charge retentive surface is reduced for precluding edge effect development. An erase device is used prior to the recharge step when the first image is a charged area image. A precharging device is utilized prior to the recharge step when the first of the two images is a discharged area image.

Edmunds teaches an electrophotographic printing machine which prints process color or highlight color documents. The printing machine operator selects either a color process unit or a highlight color process unit and inserts the selected unit into the printing machine. The printing machine prints the document corresponding to the selected unit. In this manner, either a highlight color or a full color document is printed by the same printing machine.

VonHoene et al. discloses forming orthographic color images. A relatively high resolution ROS is utilized to simultaneously form a plurality of full contrast images. Tri-level development is used to create the color images.

Snelling teaches a color image creation using tri-level development where the image color is user selectable. Selection of a desired color establishes the voltage bias of a plurality of developer stations which, in turn determines how much of each successive color toner is deposited on a particular image.

Sugizaki et et al. discloses a method for forming an image with a copying machine capable of both color copying and black and white copying. This is accomplished by having a black toner that is heat sensitive, the black toner having a low gloss finish for black and white copying and a high gloss finish for color copying.

Hauser teaches a multilevel fuser for fixing toner to a sheet at varying temperatures, pressures and dwell-times. In the case of multicolor copiers and printers, the task of fixing the toned image to the sheet is complex with multiple layers of toner transferred to a widely varying substrate sheets so as to achieve different matte and gloss finishes. As the single or multicolored toner is applied to the substrate, different temperatures, pressures, and/or dwell times may be required to attain the characteristics and image quality to create the single or multicolor copy or print.

Haneda et al. discloses a color image forming apparatus in which a color image is formed on a photoreceptor belt by electrophotography and the formed color image is transferred onto a transfer sheet. The photoreceptor is rotated at least five times when a color image is formed by the processes of charging, exposing, transferring and cleaning. The cleaning step is performed in the fifth rotation of the photoreceptor, there being no development step in the fifth rotation.

U.S. patent application Ser. No. 08/583,911, filed on Jan. 11, 1996, is directed to creating high gloss, light-fast color toner images which exhibit a high degree of scuff or abrasion resistance. In carrying out the invention, a fifth developer housing is provided in a color image creation apparatus normally comprising only four developer housings. The additional housing contains a mixture of a clear polymeric material and a material which absorbs Ultraviolet Light (UV) for minimizing color image degradation due to ultraviolet light. The clear polymer comprises a material exhibiting hydrophobic properties resulting in imaged substrates which are scuff or scratch resistant as well as resistant to damage from liquids and resistant to color degradation from exposure to UV.

All of the above references are hereby incorporated by reference.

SUMMARY OF THE INVENTION

In accordance with one aspect of the invention a method for creating image on image process color images representing a document in a printing machine is disclosed. A first latent image on a charge retentive surface moving along an endless path is developed with a first black development material; the charge retentive surface and the first black developed image are recharged; at least a second latent image is recorded and developed with a non-black development material; the charge retentive surface and the first black and the at least second non-black developed images are recharged; and a last latent image is recorded on the charge retentive surface and developed with a second black development material.

Another aspect of the invention is drawn to a printing machine for creating image on image process color images representing a document. The printing machine has a charge retentive surface moving along an endless path; a charging station for charging the charge retentive surface; an imaging and exposure station for recording latent images; a first development station for developing a first latent image on the charge retentive surface resulting in a first black developed image; a second, third and fourth development station for developing a second, third and fourth latent image on the charge retentive surface resulting in a first, second and third non-black color developed image; and a fifth development station for developing a fifth latent image on the charge retentive surface resulting in a second black developed image.

Yet another aspect of the invention is a printing machine for creating image on image process color images representing a document with a charge retentive surface moving along an endless path; a charging station for charging the charge retentive surface; an imaging and exposure station for recording latent images; a first development station for developing a first and a last black image on the charge retentive surface, the first and second black developed images being formed in two different revolutions of the charge retentive surface; and at least a second development station for developing at least one non-black color image.

The placement of black in the REaD image on image process color development sequence onto the photoreceptor of current REaD systems is problematical. Black first is preferred for hiding registration errors and for curl minimization. Black last is preferred for undercolor removal and color gamut maximization. Having two black developer steps in the image creation process allows black to be placed first and last, optimizing the color image produced. Adding a fifth developer station to the process allows two different black toners to be used; one black toner having a glossy finish for color images and the second black toner having a matte finish for non-colored text.

DETAILED DESCRIPTION OF THE INVENTION

This invention relates to an imaging system which is used to produce an image on image color output in which there may be two black development steps. It will be understood, however, that it is not intended to limit the invention to the embodiments disclosed. On the contrary, it is intended to cover all alternatives, modifications and equivalents as may be included within the spirit and scope of the invention as defined by the appended claims.

Figure 1:
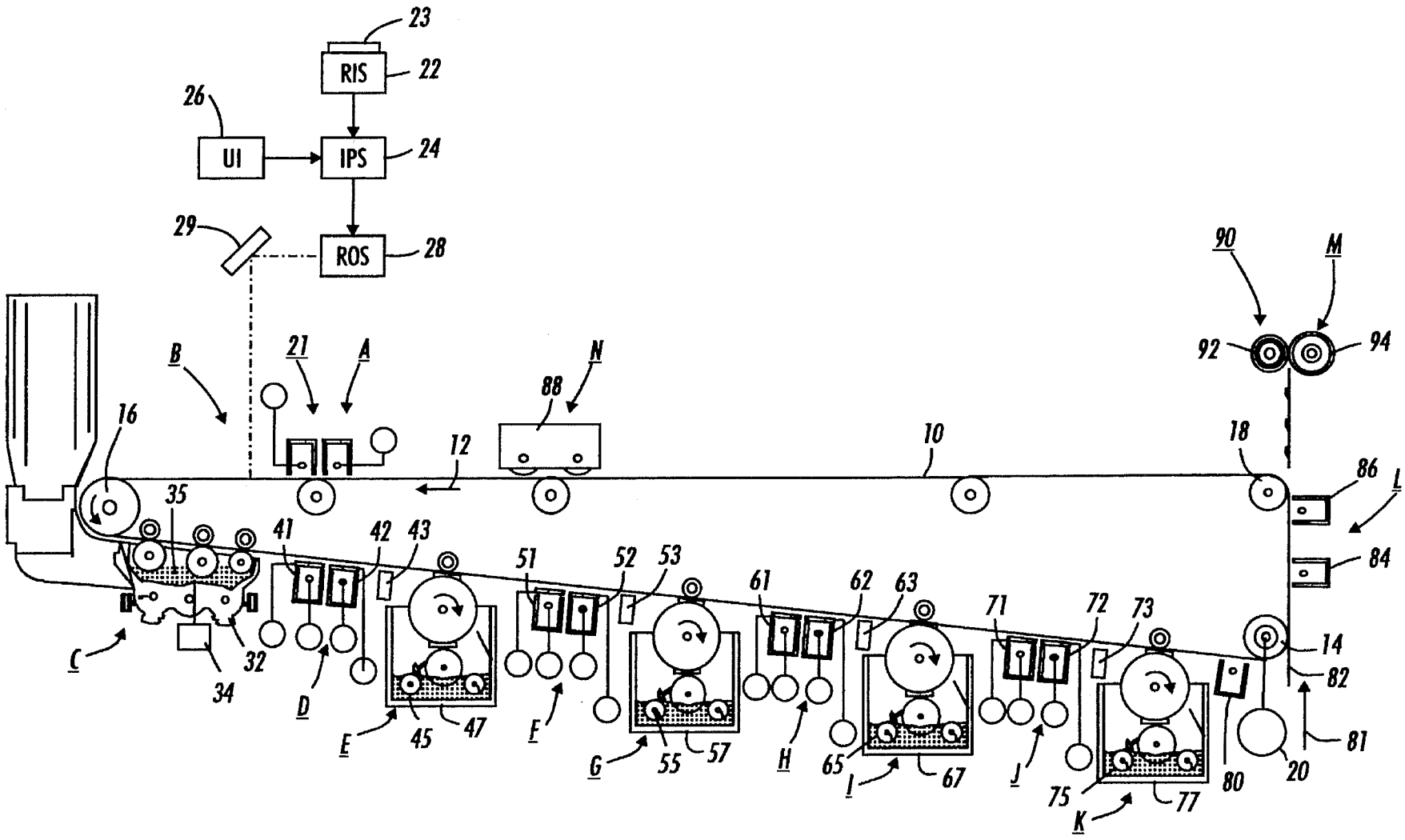
FIG. 1 is a schematic illustration of an example single pass imaging apparatus.

Turning now to FIG. 1, the electrophotographic printing machine uses a charge retentive surface in the form of an Active Matrix (AMAT) photoreceptor belt 10. The photoreceptor belt is supported by rollers 14, 16 and 18. Motor 20 operates the movement of roller 14, which in turn causes the movement of the photoreceptor in the direction indicated by arrow 12, for advancing the photoreceptor sequentially through the various xerographic stations.

With continued reference to FIG. 1, a portion of belt 10 passes through charging station A where a corona generating device, indicated generally by the reference numeral 21, charges the photoconductive surface of belt 10 to a relatively high, substantially uniform potential. For purposes of example, the photoreceptor is negatively charged, however it is understood that the present invention'could be useful with a positively charged photoreceptor, by correspondingly varying the charge levels and polarities of the toners, recharge devices, and other relevant regions or devices involved in the image on image color image formation process, as will be hereinafter described.

Next, the charged portion-of photoconductive surface is advanced through an imaging and exposure station B. A document 23, with a multi-color image and/or text original is positioned on a raster input scanner (RIS), indicated generally by the reference numeral 22. One common type of RIS contains document illumination lamps, optics, a mechanical scanning drive and a charged coupled device. The RIS captures the entire image from original document 23 and converts it to a series of raster scan lines and moreover measures a set of primary color densities, i.e. red, green and blue densities at each point of the original document. This information is transmitted as electrical signals to an image processing system (IPS), indicated generally by the reference numeral 24. IPS 24 converts the set of red, green and blue density signals to a set of colorant signals.

The IPS contains control electronics which prepare and manage the image data flow to a raster output scanning device (ROS), indicated by numeral 28. A user interface (UI) indicated by 26, is in communication with IPS 24. UI 26 enables an operator to control the various operator adjustable functions. The operator actuates the appropriate keys of UI 26 to adjust the parameters of the copy. UI 26 may be a touch screen or any other suitable control panel providing an operator interface with the system. The output signal from UI 26 is transmitted to the IPS 24. The IPS then transmits signals corresponding to the desired image to ROS 28, which creates the output copy image. ROS 28 includes a laser with rotating polygon mirror blocks. The ROS illuminates, via mirror 29, the charged portion of a photoconductive belt 10. The ROS will expose the photoconductive belt to record single to multiple images which correspond to the signals transmitted from IPS 24.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

At a first development station C, indicated generally by the reference numeral 32, advances development material 35 into contact with the electrostatic latent image. The development housing 32 contains black toner. Appropriate developer biasing is accomplished via power supply 34. Electrical biasing is such as to effect discharged area development (DAD) of the lower (less negative) of the two voltage levels on the photoreceptor with the development material 35. This development system may be either an interactive or non-interactive system.

At recharging station D, a pair of corona recharge devices 41 and 42 are employed for adjusting the voltage level of both the toned and untoned areas on the photoreceptor surface to a substantially uniform level. A power supply coupled to each of the electrodes of corona recharge devices 41 and 42 and to any grid or other voltage control surface associated therewith, serves as a voltage source to the devices. The recharging devices 41 and 42 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 41 overcharges the photoreceptor surface 10 containing previously toned and untoned areas, to a level higher than the voltage level ultimately required for $V_{ddp}$, for example to −700 volts, The predominant corona charge delivered from corona recharge device 41 is negative. The second corona recharge device 42 reduces the photoreceptor surface 10 voltage to the desired $V_{ddp}$, −500 volts. Hence, the predominant corona charge delivered from the second corona recharge device 42 is positive. Thus, a voltage split of 200 volts is applied to the photoreceptor surface. The voltage split ($V_{split}$) is defined as the difference in photoreceptor surface potential after being recharged by the first corona recharge device and the second corona recharge device, e.g. $V_{split}$ =−700 volts−500 volts =200 volts. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive).

The recharge devices have been described generally as corona generating devices, with reference to FIG. 1. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

A high slope, voltage sensitive DC device is used for the first corona recharge device, and a high slope, voltage sensitive AC device is used for the second corona recharge device. This configuration accomplishes the stated objectives of achieving voltage uniformity between previously toned areas and untoned areas of the photoreceptor so that subsequent exposure and development steps are effected across a uniformly charged surface; as well as reducing the residual charge of the previously developed areas so that subsequent development steps are effected across a uniform development field. Further, these objectives are successfully attained while ensuring that toner charge at the top of the toner layer is substantially neutralized rather than driven to reverse its polarity, so that UCS occurrence is avoided.

A second exposure or imaging device 43 which may comprise a laser based output structure is utilized for selectively discharging the photoreceptor on toned areas and/or bare areas to approximately –50volts, pursuant to the image to be developed with the second color developer. After this point, the photoreceptor contains toned and untoned areas at relatively high voltage levels (e.g. –500 volts) and toned and untoned areas at relatively low voltage levels (e.g. –50 volts). These low voltage areas represent image areas which are to be developed using discharged area development. To this end, a negatively charged developer material 45 comprising, for example, yellow color toner is employed. The toner is contained in a developer housing structure 47 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 45.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. A third exposure or imaging station 53 creates the third latent image. The recharging, imaging and developing process is similar to that of stations D and E and will not be described in detail. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging and developing processes are again similar to those described for stations D and E and will not be described in detail.

A fourth latent image is created using an imaging or exposure device 63. A fourth DAD image is formed on both bare areas and previously toned areas of the photoreceptor that are to be developed with the fourth color image. This image is developed, for example, using a cyan color toner 65 contained in developer housing 67 at a fourth developer station I. Suitable electrical biasing of the housing 67 is provided by a power supply, not shown.

The present invention adds a fourth recharging station J, a pair of corona recharge devices 71 and 72 are employed for adjusting the voltage level of both the toned and untoned areas on the photoreceptor to a substantially uniform level. A power supply coupled to each of the electrodes of corona recharge devices 71 and 72 and to any grid or other voltage control surface associated therewith, serves as a voltage source to the devices. Again the recharging, imaging and developing steps are similar to that of stations D and E.

A fifth latent image is created using an imaging or exposure device 73. A fifth DAD image is formed on both bare areas and previously toned areas of the photoreceptor that are to be developed with the fifth color image. This image is developed, for example, using a glossy black color toner 75 contained in developer housing 77 at a fifth developer station K. Suitable electrical biasing of the housing 77 is provided by a power supply, not shown.

The developer housing structures 47, 57, 67 and 77 are preferably of the type known in the art which do not interact, or are only marginally interactive with previously developed images. For example, a DC jumping development system, a powder cloud development system, and a sparse, non-contacting magnetic brush development system are each suitable for use in an image on image color development system. A noninteractive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 80 delivers negative corona to ensure that all toner particles are of the required negative polarity to ensure proper subsequent transfer. Another manner of ensuring the proper charge associated with the toner image to be transferred is described in U.S. Pat. No. 5,351,113, the relevant portions of which are hereby incorporated by reference herein.

Subsequent to image development a sheet of support material 82 is moved into contact with the toner images at transfer station L. The sheet of support material is advanced to transfer station L by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station L.

Transfer station L includes a transfer corona device 84 which sprays positive ions onto the backside of sheet 82. This attracts the negatively charged toner powder images from the belt 10 to sheet 82. A detack corona device 86 is provided for facilitating stripping of the sheets from the belt 10.

After transfer, the sheet continues to move, in the direction of arrow 81, onto a conveyor (not shown) which advances the sheet to fusing station M. Fusing station M includes a fuser assembly, indicated generally by the reference numeral 90, which permanently affixes the transferred powder image to sheet 82. Preferably, fuser assembly 90 comprises a heated fuser roller 92 and a backup or pressure roller 94. Sheet 82 passes between fuser roller 92 and backup roller 94 with the toner powder image contacting fuser roller 92. In this manner, the toner powder images are permanently affixed to sheet 82 after it is allowed to cool. After fusing, a chute, not shown, guides the advancing sheets 82 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles may be removed at cleaning station N using a cleaning brush structure contained in a housing 88.

The various machine functions described hereinabove are generally managed and regulated by a controller preferably in the form of a programmable microprocessor (not shown). The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

Figure 2:
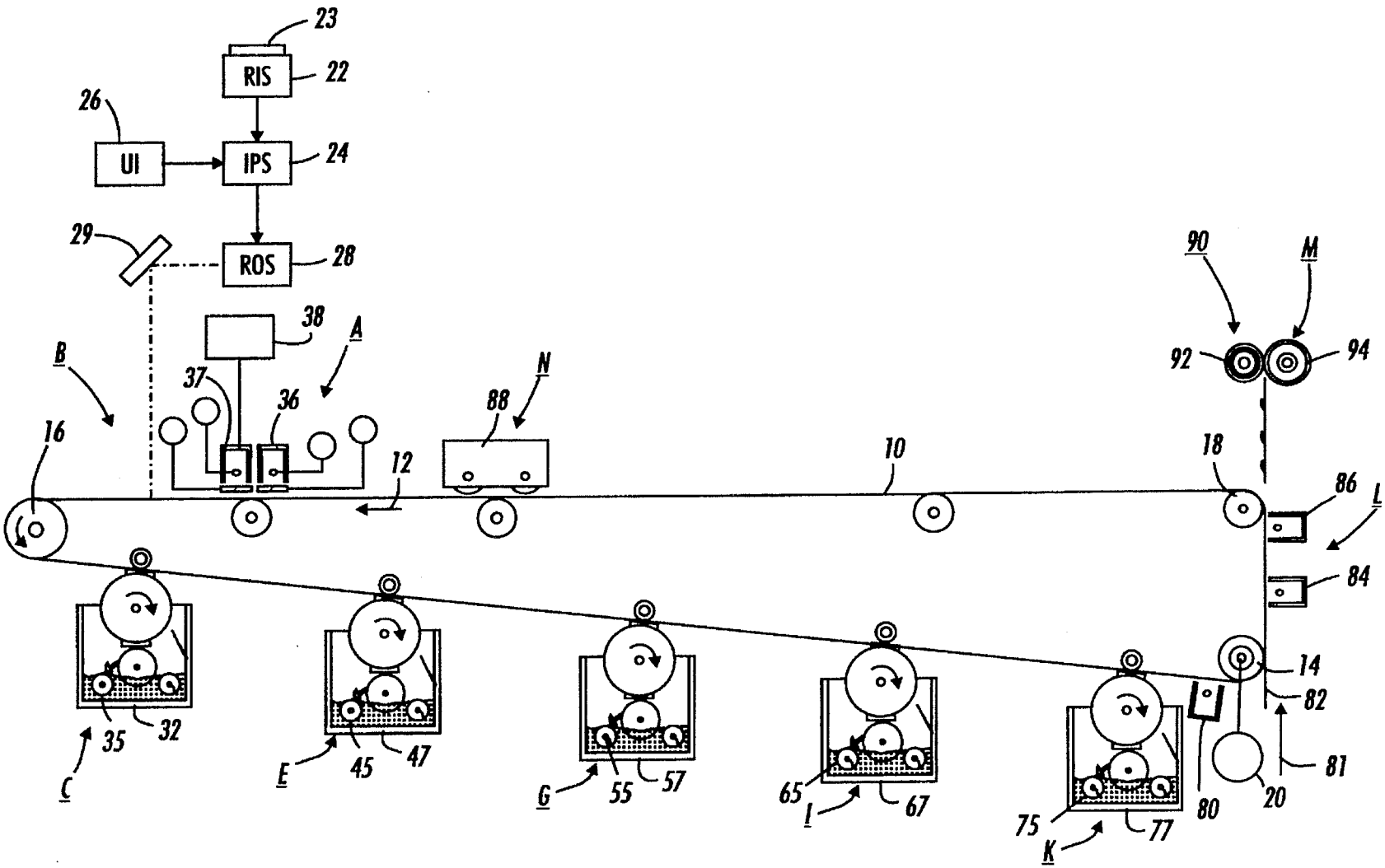
FIG. 2 is a schematic illustration of a five-pass imaging apparatus.

FIG. 2 illustrates another example of an electrostatographic printing apparatus which would find advantageous use of the present invention. FIG. 2 represents a multiple pass color image formation process, where each successive color image is applied in a subsequent pass or rotation of the photoreceptor. Like reference numerals to those in FIG. 1 correspond with identical elements to those represented in FIG. 2, with the exception that a non-interactive development system at Development Station C replaces the magnetic brush development system used as an example in FIG. 1, for purposes of illustration of alternate and equivalent embodiments for use with the present invention. Furthermore, in a multi-pass system as represented in FIG. 2, only a single set of recharging devices 36 and 37, indicated generally at charging/recharging station A, is needed to recharge the photoreceptor surface 10 prior to each subsequent color image formation. For purposes of simplicity, both recharging devices 36 and 37 can be employed for initially charging the photoreceptor using the split recharge concept of the present invention as hereinbefore described, prior to the exposure of the first color toner latent image. However, it is understood that a controller (not shown) could be used to regulate the charging step so that only a single recharge device is used to charge the photoreceptor surface to the desired voltage level for exposure and development thereon. Also, only a single exposure device is needed to expose the photoreceptor prior to each color image development. In a multipass system as illustrated in FIG. 2, it is understood that the cleaning station N is of the type that is capable of camming away from the surface of the photoreceptor during the image formation process, so that the image is not disturbed prior to image transfer.

The following is an example operation of the multi-pass color image formation process which uses an additional black developing station. In order for all five of the developing stations to be used the photoreceptor must make five passes for each full image developed.

During the first cycle, recharging device 37 initially charges the photoreceptor to $V_O$ for the desired $V_{ddp}$, the photoreceptor is exposed and the image is developed. There is no recharge used for imaging in the first cycle. After the first image is developed, the recharging corona device 36 acts as the first recharging device and applies the correct charge to the photoreceptor and toner image. The charge applied by the recharging corona device 36 is the first overcharge value which equals $V_{ddp}$ plus the intended split differential voltage.

For the second cycle, recharging device 37 charges the photoreceptor and the applied toner to the desired $V_{ddp}$ for imaging; acting as the second corona of the split charge operation. The second image is developed, and the photoreceptor passes the recharging corona device 36, which again charges the photoreceptor and toner to the desired over charge value.

This process is repeated for the third, fourth and fifth cycles until the image is completely developed on the fifth cycle. After the image has been developed on the fifth cycle, the pre-transfer device 80 is activated and for the rest of the fifth cycle, the transfer 84, detack 86 and cleaning station N devices are activated in a manner similar to that previously described with respect to FIG. 1.

For most applications $V_{ddp}$ will vary with each cycle, depending upon charges required for proper toner application and development, so a controller 38 has been added to the charging station A. For example, values for $V_{ddp}$ are −350V for the first image to be developed with the first black toner, −350V for the second image to be developed with yellow toner, −400V for the third image to be developed with magenta toner and −450V for the fourth image to be developed with the cyan toner and −500V for the fifth image to be developed with the second black toner. The first and second recharging devices are controlled so that the desirable Vsplit voltage of approximately 200 V is maintained for each cycle.

In the case of the five developer housing configuration of FIGS. 1 and 2, the image processing software can enable the selection of low gloss black first or black last or high gloss black first or black last. This enables the very desirable combination of low gloss text and high gloss pictorials on the same page.

Figure 3:
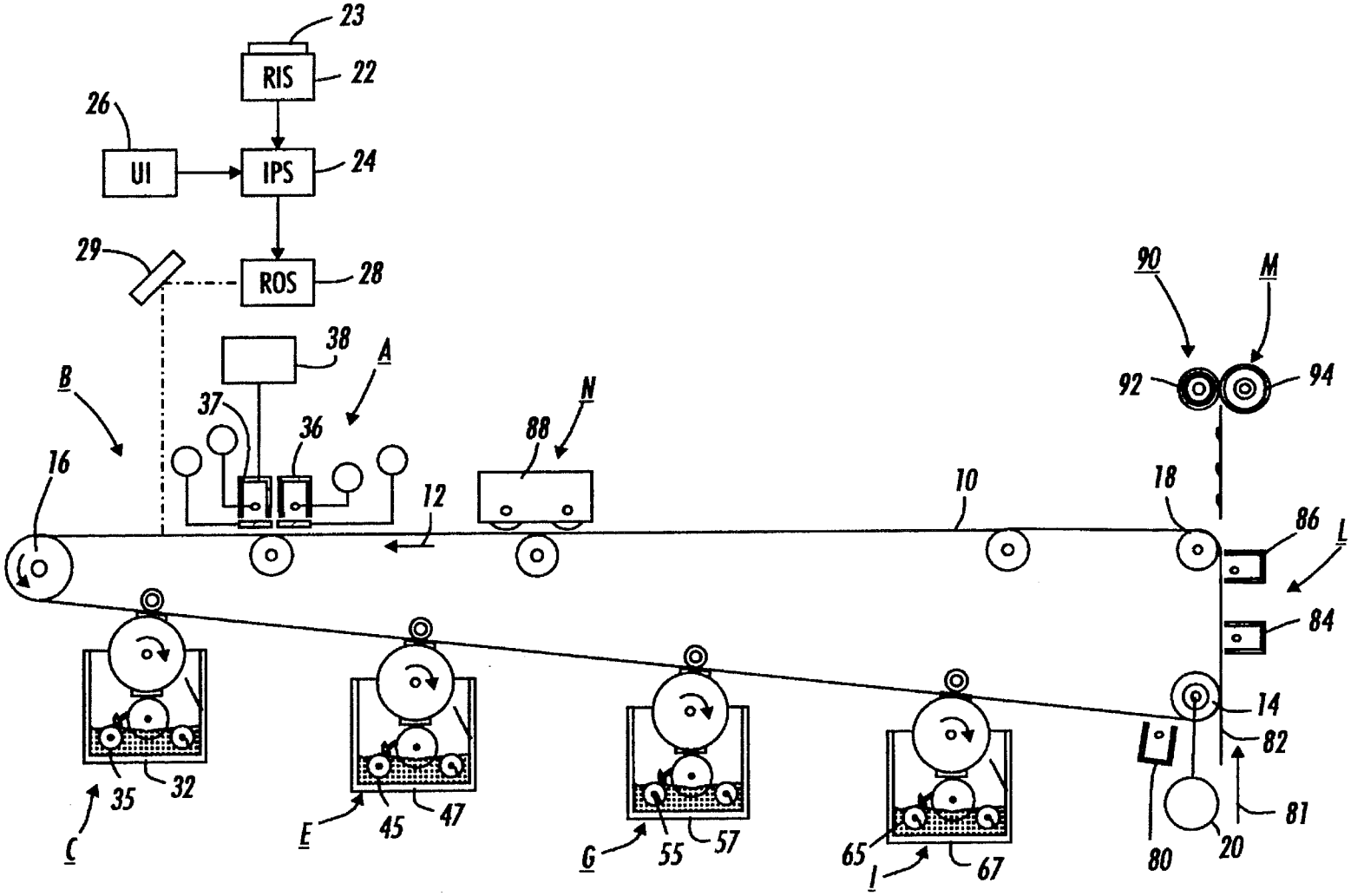
FIG. 3 is a schematic illustration of an another example of a five-pass imaging apparatus.

FIG. 3 also represents multipass system with only four developer housings. Rather than having two black developing stations, the second application of black toner is provided by developer station C, the same developer station which provides the first application of black toner. In the first four passes, the first black, yellow, magenta and cyan toners are developed and in the fifth pass the second black toner is applied. This system allows for the black toner to be applied twice in the development of an image, however does not provide for two different types of black toner, for example, glossy and non-glossy toner, to be used. This process will work well for full page color or full page text applications where the fuser operation can be controlled to provide either a gloss or matte finish to the developed page.

For both FIGS. 2 and 3, the fifth pass may be optional, depending upon the color quality desired by the user, allowing for an explicit tradeoff of productivity versus color quality. The optional sequence could be enabled by the user, but triggered by the image processing system only in those cases where it was advantageous to color quality.

The various machine functions described above are generally managed and regulated by a controller which provides electrical command signals for controlling the operations described above.

While the foregoing description was directed to a $DAD^n$ image on image process color printer where a full color image is built successively on the charge retentive surface, it will be appreciated that the invention may also be used in a charged area development $CAD^n$ or $CAD\text{-}DAD^n$.

Figure 4:
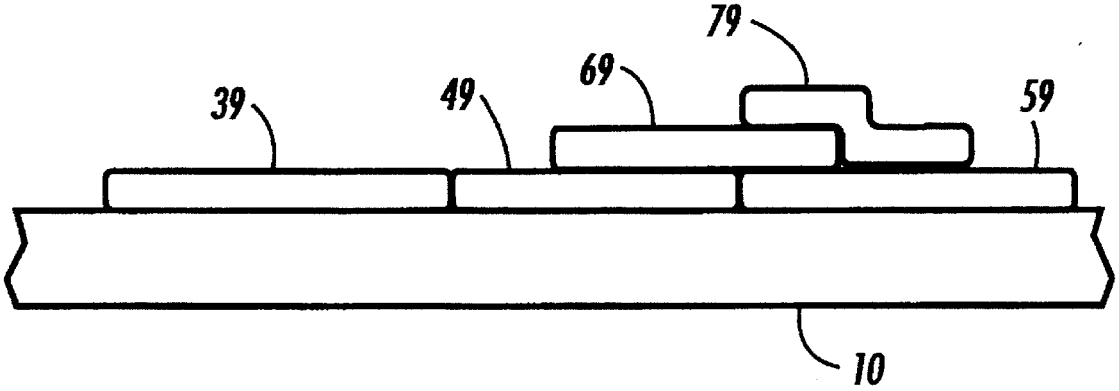
FIG. 4 is cross section of the developed image.

FIG. 4 shows a cross-section of the developed image on the photoreceptor 10. Using the development configurations of FIGS. 1–3, the first toner layer 39 is black, the second toner layer 49 is yellow, the third toner layer 59 is magenta, the fourth toner layer 69 is cyan and the fifth toner layer 79 is another black toner layer. The exact order of the the nonblack is not essential to the invention.

It is, therefore, apparent that there has been provided in accordance with the present invention, a method and apparatus for creating multiple images in which a corona generating device serves two purposes that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A method for creating image on image process color images representing a document in a printing machine comprising:

recording a first latent image on a charge retentive surface moving along an endless path;

developing the first latent image on the charge retentive surface with a first black development material;

recharging the charge retentive surface and the first black developed image;

recording at least a second latent image;

developing the second latent image on the charge retentive surface with a non-black development material;

recharging the charge retentive surface and the first black and the at least second non-black developed images;

recording a last latent image on the charge retentive surface; and developing the last latent image on the charge retentive surface with a second black development material, wherein developing the first latent image is an interactive development process and developing the last latent image is a non-interactive development process.

2. The method for creating images as claimed in claim 1, wherein developing the first, the second, and the last latent images occur in a single revolution of the charge retentive surface.

3. The method for creating images as claimed in claim 2, wherein the first development material includes a high gloss black toner.

4. The method for creating images as claimed in claim 3, wherein the second black development material includes a low gloss black toner.

5. The method for creating images as claimed in claim 2, wherein the first development material includes a low gloss black toner.

6. The method for creating images as claimed in claim 5, wherein the second black development material includes a high gloss black toner.

7. The method for creating images as claimed in claim 5, wherein the first black and second black developed images are developed with the same black toner.

8. The method for creating images as claimed in claim 1, wherein developing the first, the second, and the last latent images occur in five revolutions of the charge retentive surface.

9. The method for creating images as claimed in claim 8, wherein the first development material includes a high gloss black toner.

10. The method for creating images as claimed in claim 9, wherein the second black development material includes a low gloss black toner.

11. The method for creating images as claimed in claim 8, wherein the first development material includes a low gloss black toner.

12. The method for creating images as claimed in claim 11, wherein the second black development material includes a high gloss black toner.

13. A printing machine for creating image on image process color images representing a document comprising:

a charge retentive surface moving along an endless path;

a charging station for charging the charge retentive surface;

an imaging and exposure station for recording latent images;

a first development station for developing a first latent image on the charge retentive surface resulting in a first black developed image;

a second, third and fourth development station for developing a second, third, and fourth latent image on the charge retentive surface resulting in a first, second and third non-black color developed image; and a fifth development station for developing a fifth latent image on the charge retentive surface resulting in a second black developed image, wherein the first development station applies to a low gloss black toner.

14. A printing machine as claimed in claim 13, wherein the fifth development station applies a low gloss black toner.

15. A printing machine as claimed in claim 13, wherein the fifth development station applies a high gloss black toner.

16. A printing machine as claimed in claim 13, further comprising:

a first, second, third and fourth recharging station for recharging the first, second, third and fourth developed images.

17. A printing machine for creating image on image process color images representing a document comprising:

a charge retentive surface moving along an endless path;

a charging station for charging the charge retentive surface, an imaging and exposure station for recording latent images;

a first development station for developing a first and a last black image on the charge retentive surface, the first and second black developed images being formed in two different revolutions of the charge retentive surface; and at least a second development station for developing at least one non-black color image that is developed between the first black developed image and second black developed image.

18. A method for creating image on image process color images representing a document in a printing machine comprising:

recording a first latent image on a charge retentive surface moving along an endless path;

developing the first latent image on the charge retentive surface with a first black development material;

recharging the charge retentive surface and the first black developed image;

recording at least a second latent image;

developing the second latent image on the charge retentive surface with a non-black development material;

recharging the charge retentive surface and the first black and the at least second non-black developed images;

recording a last latent image on the charge retentive surface; and developing the last latent image on the charge retentive surface with a second black development material, wherein the first black development material includes a low gloss black toner.

19. A method as claimed in claim 18, wherein the second black development material includes a high gloss black toner.

20. A printing machine for creating image on image process color images representing a document comprising:

a charge retentive surface moving along an endless path;

a charging station for charging the charge retentive surface;

an imaging and exposure station for recording latent images;

a first development station for developing a first black latent image on the charge retentive surface a second development station for developing a non-black latent image;

a last development station for developing a last black latent image on the charge retentive surface, wherein the first and last black developed images are contained in a colored area portion of the document.

* * * * *